United States Patent [19]

Inoue et al.

[11] Patent Number: 4,801,340

[45] Date of Patent: Jan. 31, 1989

[54] METHOD FOR MANUFACTURING PERMANENT MAGNETS

[75] Inventors: Nobuyuki Inoue; Katsumi Takahashi; Nobuo Imaizumi, all of Tokyo, Japan

[73] Assignee: Namiki Precision Jewel Co., Ltd., Tokyo, Japan

[21] Appl. No.: 60,414

[22] Filed: Jun. 11, 1987

[30] Foreign Application Priority Data

Jun. 12, 1986 [JP] Japan ..... 61-134865

[51] Int. Cl.[4] ..... H01F 1/02

[52] U.S. Cl. ..... 148/103; 148/104; 148/302; 419/12; 419/23

[58] Field of Search ..... 148/101, 102, 103, 104, 148/105, 302; 75/0.5 C; 419/12, 23, 31, 33, 38

[56] References Cited

U.S. PATENT DOCUMENTS 4,585,473 4/1986 Narasimhan et al. ..... 148/104

*Primary Examiner*—John P. Sheehan

*Attorney, Agent, or Firm*—Gerald J. Ferguson, Jr.

[57] ABSTRACT

A method for manufacturing a permanent magnet using alloys of the formula $R(T_{1-y}M_y)_z$, wherein R denotes one or two species of rare earth metals, including Y, T denotes transition metals, principally Fe or Fe and Co, M denotes metalloid elements, principally B, and wherein $0.02<y<0.15$, and $5<z<9$), to obtain permanent magnets with high orientation properties through the formation of 50–1000 μm crude grains by spraying the alloys in a hot melt state using an inert gas atomization process, forming grains of less than 30 μm by a mechanical pulverizing process after crystal texture in the crude grains has grown to over 30 μm granules by a heat-treatment of the crude grains in a vacuum or in an inert atmosphere below 1000° C., whereupon the grain powder is compression molded and heat treated at 500°–900° C. under a magnetic field to yield a compacted powder permanent magnet.

9 Claims, 3 Drawing Sheets

METHOD FOR MANUFACTURING PERMANENT MAGNETS

BACKGROUND OF THE INVENTION

1. Field of the Invention

This invention relates to a method of manufacturing a permanent magnet with $R(T_{1-y}M_y)_z$, as the chief components, wherein R denotes one or two species of rare earth metals, including Y, T denotes transition metals, principally Fe or Fe and Co, M denotes metalloid elements, principally B, and wherein $0.02 \leqq y \leqq 0.15$, and $5 \leqq z \leqq 9$.

2. Description of Prior Art

Since it was discovered that, among the rare earth transition metal alloys, intermetallic compounds having a 2:17 ratio of rare earth metals to transition metals theoretically possess very high magnetic properties [(BH) max-50 MGOe], various attempts have been made to obtain practical permanent magnet alloys with compounds of the above system as the chief component.

For example, the high magnetic property of (BH) max-30 MGOe was achieved with an intermetallic compound of the Sm-Co-Cu-Fe system and that of (BH) max-40 GOe with an intermetallic compound of the Nd-Fe system. These composite alloys were generally manufactured by processes used for sintered permanent magnets, i.e., pulverizing, compression-molding while oriented in a magentic field or compression molding in a non-magnetic field, and sintering, melting and aging.

The conventional methods for obtaining fine particles include the mechanical pulverizing of ingots, the rough pulverizing by hydrogenation of ingots to cause brittleness in a high pressure hydrogen atmosphere followed by fine pulverizing upon dehydrogenation, and (as shown in U.S. Pat. No. 4,585,473), the forming of a spherical crude power of about 100 μm by spraying the melt substance with an inert gas atomization technique and further mechanical pulverization to the desired particle size.

However, in the case of fine pulverization of alloys with the composition shown by the general formula $R(T_{1-y}M_y)_z$, wherein R denotes one or two species of rare earth metals, including Y, T denotes transition metals, principally Fe or Fe and Co, M denotes metalloid elements, principally B, and wherein $0.02<y<0.15$, and $5<z<9$, the powder formed by mechanically pulverizing ingots effectively produces magnetically aligned solids during the subsequent oriented compression-molding in a magnetic field.

In the case of using gas atomization techniques, although they are advantageous in their simple processing, minute crystals of 0.1–10 μm are magnetically formed at random in each grain during the rapid solidification following atomization. Consequently, there were shortcomings such that, unless the minute crystals are pulverized to less than 1 μm in the subsequent fine pulverization process, a high degree of orientation is not achieved during molding in a magnetic field, resulting in a permanent magnet with an inferior angularity of the demagnetization curve. Furthermore, another shortcoming is that the sintering temperature, which normally ranges between 1000°–1200° C., causes the final magnet to be completely sintered, thus making the formation process difficult.

OBJECT OF THE INVENTION

In view of the above, the purpose of the present invention is to offer a manufacturing process for obtaining compacted powder permanent magnets that are virtually the same as sintered solid, and to obtain a manufacturing process for a permanent magnet with improved angularity of the demagnetization curve.

SUMMARY OF THE INVENTION

With regard to alloys whose compositions are determined by the formula $R(T_{1-y}M_y)_z$, wherein R denotes one or two species of rare earth metals, including Y, T denotes transition metals, principally Fe or Fe and Co, M denotes metalloid elements, principally B, $0.02<y<0.15$, $5<z<9$, the purpose of the present invention is to obtain a powder for permanent magnets with high orientation properties through the formation of 50–1000 μm crude grains by spraying the set alloys in the melt state using an inert gas atomization process, and forming grains of less than 30 μm by a mechanical pulverizing process after crystal texture in the crude grains has grown, in essence, to over 30 μm granules by a heat treatment of the crude grains in a vacuum or in an inert atmosphere below 1000° C.

The present invention also involves a method for manufacturing compacted powder permanent magnets obtained by compression-molding of the above-discussed powder. More preferably, compacted powder permanent magnets are obtained by eliminating the mechanical strain produced during the formation process by heating the formed bodies in the temperature range of 500°–900° C. in a magnetic field above 100 Oe and also improving the magnetic orientation property. Additionally, a resin-bonded permanent magnet is stabilized against oxidation by hardening with resin impregnated in the spaced of formed bodies, and a permanent magnet undergoes hot isostatic compression at a pressure of above 50 kg/cm$^2$ and in the temperature range of 600°–900° C. by vacuum-sealing the formed bodies in a metal container of, for example, stainless steel. Additionally obtained is a permanent magnet for which the forming bodies are sintered at a temperature of from 1000°–1200° C.

Figure 1:
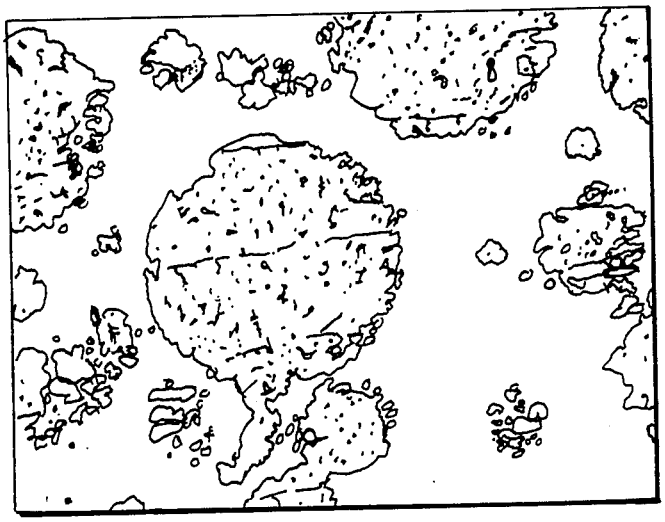
FIGS. 1 and 2 are, respectively, optical micrographs (magnification ×400) of the metal texture following etching comparing the powder of the present invention following atomization to the conventional powder.

In the above drawings, the numbers 1, 3, and 5 refer to the conventional product, while the numbers 2, 4, and 6 refer to the product of the present invention.

DETAILED DESCRIPTION OF THE INVENTION

Using alloys whose compositions are determined by the formula $R(T_{1-y}M_y)_z$, wherein R denotes one or two species of rare earth metals, including Y, T denotes transition metals, principally Fe or Fe and Co, M denotes metalloid elements, principally B, $0.02<y<0.15$, $5<z<9$, the purpose of the present invention is to obtain a powder for permanent magnets with high orientation properties through the formation of 50–1000 μm crude grains by spraying the set alloys in the melt state using an inert gas atomization process, and forming grains of less than 30 μm by a mechanical pulverizing process after crystal texture in the crude grains has grown, in essence, to over 30 μm granules by a heat treatment of the crude grains in a vacuum or in an inert atmosphere below 1000° C.

The present invention also involves a method for manufacturing compacted powder permanent magnets obtained by compression-molding of the above-discussed powder. More preferably, compacted powder permanent magnets are obtained by eliminating the mechanical strain produced during the formation process by heating the formed bodies in the temperature range of 500°–900° C. in a magnetic field above 100 Oe and also improving the magnetic orientation property. Additionally, a resin-bonded permanent magnet is stabilized against oxidation by hardening with resin impregnated in the spaces of formed bodies, and a permanent magnet undergoes hot isostatic compression at a pressure of above 50 kg/cm$^2$ and in the temperature range of 600°–900° C. by vacuum-sealing the formed bodies in a metal container of, for example, stainless steel. Additionally obtained is a permanent magnet for which the formed bodies are sintered at a temperature of from 1000°–1200° C.

The present invention obtains a powder for permanent magnets with high orientation properties through the formation of 50–1000 μm crude grains by spraying the set alloys in the melt state using an inert gas atomization process, and forming grains of less than 30 μm by a mechanical pulverizing process after crystal texture in the crude grains has grown, in essence, to over 30 μm granules by a heat treatment of the crude grains in a vacuum or in an inert atmosphere below 1000° C.

Compacted powder permanent magnets are obtained by compression-molding of the above powder. More preferably, compacted powder permanent magnets are obtained by eliminating the mechanical strain produced during the formation process by heating the formed bodies in the temperature range of 500°–900° C. in a magnetic field above 100 Oe and also improving the magnetic orientation property. Further, a resin-bonded permanent magnet is stabilized against oxidation by hardening with resin impregnated in the spaces of formed bodies and a permanent magnet undergoes hot isostatic compression at a pressure of about 50 kg/cm$^2$ in the temperature range of 600°–900° C. by vacuum-sealing the formed bodies in a metal container, of, for example, stainless steel. To obtain the permanent magnet the formed bodies are sintered at a temperature of 1000°–1200° C.

When the crude grain diameter is less than 50 μm after gas atomization, fine crystals of less than 1 μm are produced by superquenching, and when they exceed 1000 μm, it makes subsequent fine mechanical pulverizing difficult. In addition, a granular size of 30 μm is necessary as the minimum size for magnetic anisotropy. In a magnetic field below 100 Oe sufficient magnetic effect is not obtainable. Below 500° C. within that magnetic field, the angularity of the demagnetization curve is not markedly improved, and when heated to above 900° C., increased coercivity is not obtained.

As for the conditions for hot isostatic compression, pressure tightness does not occur below 600° C. and, above 900° C., individual particles deposit, thus limiting the temperature range to a level between these two points, and because pressure tightness is not obtainable below 50 kg/cm$^2$, this value is determined above this pressure.

When the sintering temperature is below 1000° C. complete pressure tightness is not obtained and above 1200° C., melting occurs. The temperature must, therefore, be restricted within these two figures.

The practice of the invention is illustrated in the following examples, which are intended merely to illustrate the invention, and not to limit the scope thereof.

EXAMPLE 1

Figure 2:
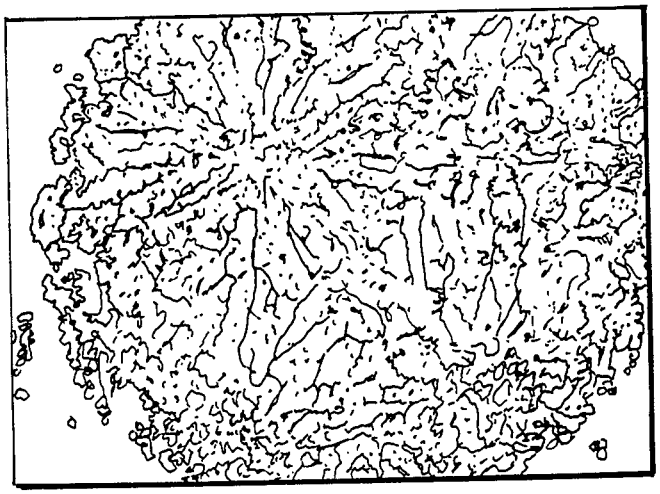
Figure 3:
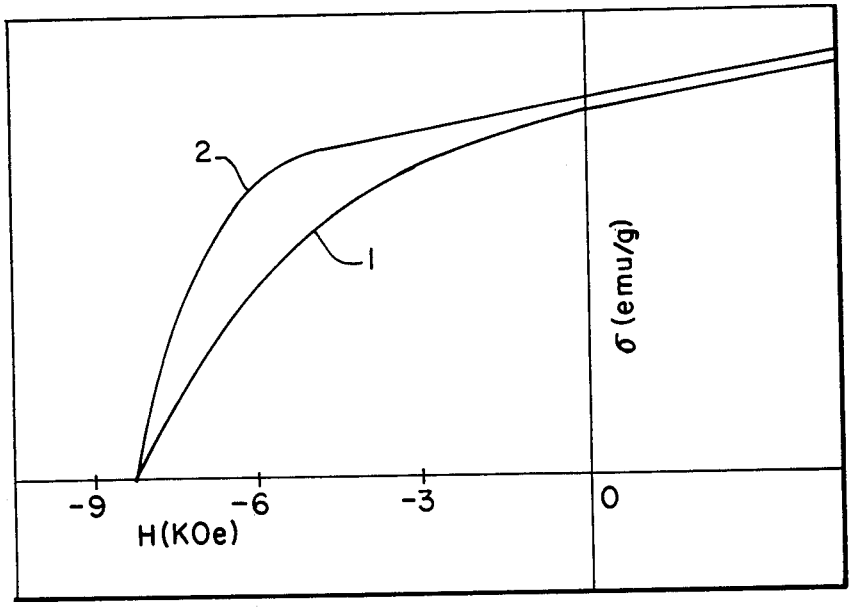
FIG. 3 shows the demagnetization curve from a vibration sample magnetometer (VSM) comparing a conventional powder with that of the present invention.

The magnetic properties of 50–100 μm powder 1, produced by spraying the Nd $(Fe_{0.78}Co_{0.14}B_{0.08})_{5.9}$ alloy from the melt state using an inert gas atomization process and powder 2, produced by heat treatment of powder 1 for 6 hours at 1000° C. and for one hour at 600° C. were determined, respectively, using a vibration sample magnetometer (VSM). FIGS. 1 and 2 are optical micrographs of the metal texture following etching, respectively, of powder 2 according to the present invention, obtained by heat-treatment of powder 1 after gas atomization for 6 hours at 1000° C. and of untreated powder 1. These figures reveal that grain boundaries are present in powder 1 whereas no grain boundaries are present in powder 2 of the present invention. In addition, as shown in FIG. 3, it is obvious that powder 2 obtained by heat treatment at 1000° C. following gas atomization has a more improved angularity of the demagnetization curve.

EXAMPLE 2

Figure 4:
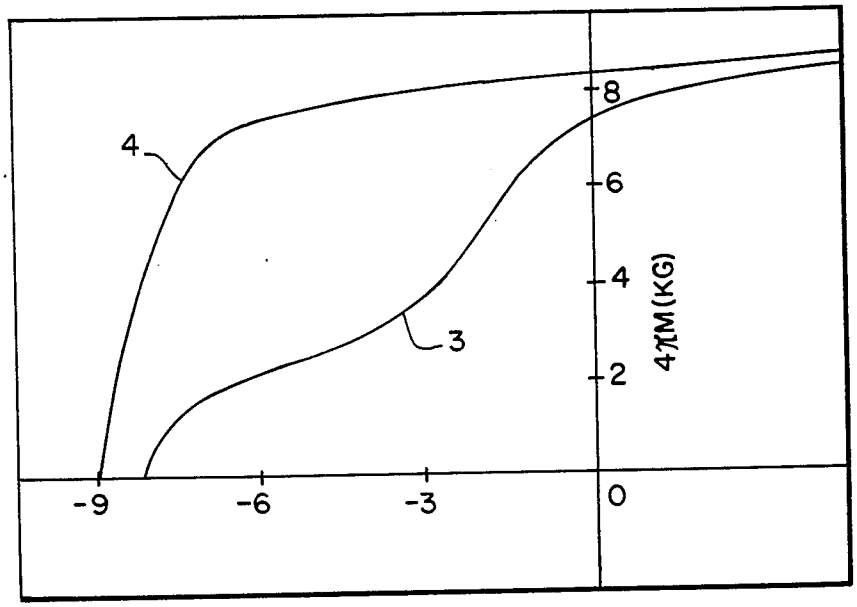
FIG. 4 shows a demagnetization curve of the magnetic properties comparing the magnetic powder with that of the present invention.

A compacted powder permanent magnet 3 was obtained by pulverizing the gas atomized powder of Example 1 into particles of about 4 μm using a vibrating mill for 30 minutes followed by compression-molding in a 10 KOe magnetic field of 4 t/cm$^2$, and magnet 4 was obtained by heat-treating magnet 3 for 1 hour at 700° C. in a vacuum and a 5 KOe magnetic field. Their magnetic properties were determined and the results as shown in FIG. 4 were obtained. From the above, it is clear that magnet 4 obtained by heat treatment at 700° C. and a 5 KOe magnetic field has a more improved angularity of the demagnetization curve.

EXAMPLE 3

Figure 5:
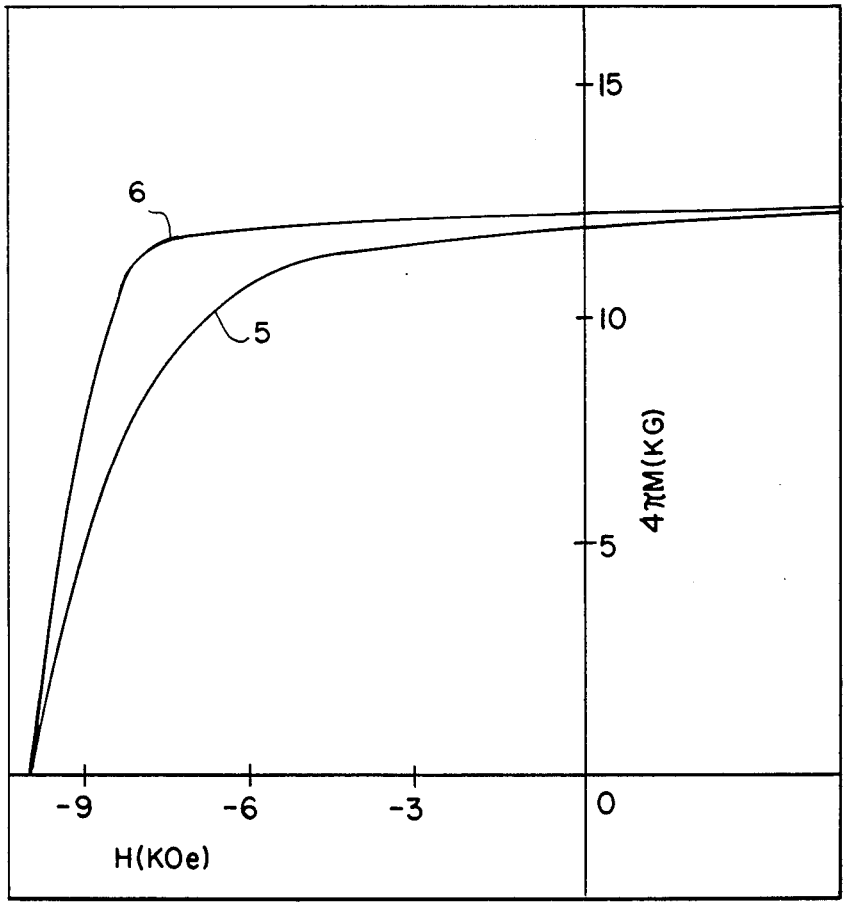
FIG. 5 shows a demagnetization curve of the magnetic properties comparing the sintered magnet of a conventional powder with that of the present invention.

Particles 5 of approximately 4 μm produced by pulverizing the gas atomized powder of Example 1 using a vibrating mill for 30 minutes and particles 6 of approximately 4 μm produced by heat-treating the same gas atomized powder for 6 hours at 1000° C. in vacuum and pulverized in a vibrating mill for 30 minutes were compression-molded, respectively, in a 10 KOe magnetic field at 4 t/cm$^2$ and sintered for 1 hour at 1000° C. Following sintering, they were heat-treated at 650° C. for 1 hour and the magnetic properties of the respective particles were determined. The results shown in FIG. 5 were obtained. It is clear that magnet 6 obtained by heat-treatment at 1000° C. following gas atomization has a more improved angularity of the demagnetization curve.

EXAMPLE 4

Alloys having the compositions of

① $La_{0.2}Pr_{0.5}Nd_{0.2}Dy_{0.1}(Fe_{0.91}B_{0.09})_6$
② $Nd_{0.8}Dy_{0.2}(Fe_{0.8}Co_{0.1}B_{0.1})_6$
③ $Nd_{0.8}Dy_{0.2}(Fe_{0.8}Co_{0.1}B_{0.1})_{4.5}$
④ $Nd_{0.8}Dy_{0.2}(Fe_{0.8}Co_{0.1}B_{0.1})_{6.5}$
⑤ $Nd(Fe_{0.93}B_{0.07})_{6.5}$ were prepared using an arc smelting furnace. 100 grams each were placed in an aluminum crucible in a vacuum container sealed in argon gas after thorough evacuation, and were heated to melt using a high frequency heater. Perforations 2 mmϕ were made at the bottom of the aluminum crucibles, through which the melted alloy was extruded by introducing argon (Ar) gas applied from the top of the crucible. The melted alloy extruded forms spherical particles as it is turned to mist by an argon (Ar) jet emitted from a nozzle at the bottom of the crucible and is concurrently solidified by rapid cooling. The particles are recovered in a particle collector vessel attached to a water-cooled pipe. After the spherical particles of the respective alloys (1)-(5) obtained in this manner are mechanically pulverized to produce 1-10 μm particles using a vibrating mill, they were compression-molded while being oriented in a magnetic field of approximately 10 KOe to obtain the raw material. The rate of packing at this time was 60-65%. Next, the material was placed in a container made of 0.2 mm thick stainless steel which was evacuated and sealed, and the stainless steel container was placed in a hot isostatic compressor for compression at 850° C. and 1200 kg/cm$^2$. The magnetic properties of the compacted powders were determined and the results shown in Table 1 were obtained.

TABLE 1

| | RATE OF PACKING | Br | Hc | (BH) max |
|---|---|---|---|---|
| ① | 99% | 10.5 KG | 3.8 KOe | 20.5 MGOe |
| ② | 98 | 11.8 | 8.5 | 31.0 |
| ③ | 99 | 11.2 | 8.5 | 27.5 |
| ④ | 98 | 12.1 | 2.4 | 16.5 |
| ⑤ | 98 | 12.7 | 6.3 | 30.0 |

As shown above, in the case of the atomized powder, because the spherical particles are readily split in half and unnecessarily minute particles are not easily produced, not only do they pulverize easily, but also they are stable against oxidation. Furthermore, they facilitate easier handling, because 20-100 μm particles are directly obtainable by gas atomization and rapid cooling. However, adequate magnetic alignment of the particles is not sufficiently achieved by the manufacturing process of producing a molded body simply from the crude grains of the fine composite structure in a gas-atomized state or following mechanical pulverization. Consequently, the advantage gained is nothing more than simplification of the pulverizing process, but this induces a deterioration of the demagnetization curve for the formed magnet. However, it was proven that a highly grain-oriented material is obtainable by means of the pretreatment of the present invention to allow grain growth of the crystal texture in the crude grains to essentially over 30 μm by heat-treatment at 900°-1000° C. following gas atomization. Furthermore, because an adequate rate of packing is obtainable by hot isostatic compression, saturation magnetization ($B_s$) is improved. This also has the added advantage of making the molding process easier because of the compacted state of the final magnet.

What is claimed is:

1. A method for manufacturing compacted powder permanent magnets from alloys whose compositions are determined by the formula R $(T_{1-y}M_y)z$ wherein R denotes one or two species of rare earth metals including Y, T denotes a transition metal selected from the group consisting of Fe and Fe and Co, M denotes the metalloid element B, and wherein $0.02<y<0.15$, and $5<z<9$, said method comprising the steps of:

a. obtaining 50-1000 um crude grains by spraying said alloys in a melt state using an inert gas atomization process,
b. heat-treating said crude grains in a vacuum or in an inert atmosphere,
c. forming grains of less than 30 um by a mechanical pulverizing process, and
d. compression-molding said grains of (c) to form a compression molded body.

2. The method as defined by claim 1, wherein said heat-treatment is carried out in the temperature range of 900°-1000° C.

3. The method as defined in claim 1, wherein said compression molded body is heated in the temperature range of 500°-900° C. in a magnetic field of over 100 Oe.

4. The method as defined in claim 1, further comprising hardening said compression molded body by impregnating said body with resin to produce a resin-bonded permanent magnet.

5. The method as defined in claim 3, further comprising hardening said compression molded body by impregnating said body with resin following heat treatment.

6. The method as defined in claim 1, further comprising the steps of a. vacuum sealing said compression molded body in a metal container,
b. compressing said vacuum sealed compression molded body formed in step (a) with hot isostatic pressure of over 50 kg/cm$^2$ in the temperature range of 600-900 degrees C.

7. The method as defined by claim 6, further comprising quenching and then mechanically pulverizing said compression molded body with a jet mill or a ball mill to form fine particles of 2-20 um.

8. The method as defined in claim 7, further comprising orienting said compression molded body by executing the compression-molding process in a magnetic field.

9. The method as defined in claim 1, in which said compression-molded body is sintered in the temperature range of 1000°-1200° C.

* * * * *